United States Patent [19]

Kouns

[11] 4,281,971

[45] Aug. 4, 1981

[54] INLET INDUCER-IMPELLER FOR PISTON PUMP

[75] Inventor: Herbert H. Kouns, Camarillo, Calif.

[73] Assignee: ABEX Corporation, New York, N.Y.

[21] Appl. No.: 62,599

[22] Filed: Jul. 31, 1979

[51] Int. Cl.[3] ..... F04B 23/14

[52] U.S. Cl. ..... 417/203; 417/205

[58] Field of Search ..... 417/205, 206, 203

[56] References Cited

U.S. PATENT DOCUMENTS

| | | | |
|---|---|---|---|
| 2,604,047 | 7/1952 | Beaman et al. | 417/206 |
| 3,202,101 | 8/1965 | Tinker et al. | 417/203 |
| 3,476,051 | 11/1969 | Skinner | 417/205 |
| 4,025,238 | 5/1977 | Masclet | 417/206 |

*Primary Examiner*—Billy S. Taylor

*Attorney, Agent, or Firm*—Thomas S. Baker, Jr.; David A. Greenlee

[57] ABSTRACT

A pump has a pump driven impeller mounted immediately adjacent the port plate which cooperates with a collector to increase the tangential velocity of fluid entering the inlet port to substantially equal that of the barrel cylinder ports.

2 Claims, 8 Drawing Figures

INLET INDUCER-IMPELLER FOR PISTON PUMP

BACKGROUND OF THE INVENTION

This invention relates to a variable displacement axial piston pump and, more particularly, to a means for preventing cavitation in the pump over a wide range of pump speeds.

An axial piston pump has a barrel rotatably mounted within a pump housing. A plurality of equally spaced cylinders are formed at a common radius in the barrel. Each cylinder houses a piston which reciprocates as the barrel is rotated. One end of the barrel lies against a fixed port plate mounted in the housing which contains a pair of sausage-shaped ports. One of the ports is an inlet port and the other is an exhaust port. Each cylinder has a port in the end of the barrel adjacent the port plate. As the barrel is rotated, each cylinder port traverses the inlet port and the exhaust port. As the cylinder ports traverse the inlet port low pressure fluid is drawn into the cylinder. When the cylinder ports traverse the exhaust port, they expel the fluid at an increased pressure.

As the rotational speed of the pump increases, the time during which the cylinder ports traverse the inlet port decreases. If the cylinders are not completely filled with fluid after they traverse the inlet port, cavitation occurs. Noise, vibration and rapid errosion of metal surfaces contacted by the fluid, all of which are objectionable, are caused as a result of cavitation. For these reasons, cavitation must be avoided.

In order for a cylinder to fill as the cylinder port traverses the inlet port, the fluid coming through the inlet port must have a velocity component along the axis of the cylinder. This velocity component is generally derived from the pressure of the fluid coming into the inlet port. Additionally, since the cylinder port moves tangentially relative to the inlet port, it is desirable to have the fluid enter the inlet port with a tangential velocity component as well as an axial component. If the fluid entering the inlet port has a tangential velocity component substantially equal to the tangential velocity of the cylinder port, the time for filling the cylinder is greatly reduced and cavitation is prevented at increased pump speeds. In fact, increasing the tangential velocity component of the fluid has a greater effect on decreasing the time it takes to fill a cylinder than a correspondng increase in the axial velocity component.

One method of reducing cavitation is to precharge or supercharge the fluid coming into the inlet port. This is accomplished by having an auxiliary pump increase the pressure and hence the energy of the fluid above the minimum required to ensure complete filling of the barrel cylinders at all pump operating speeds. Supercharging the incoming fluid by an auxiliary pump has a number of disadvantages. An auxiliary pump adds to the cost of a hydraulic system and also occupies space which is sometimes at a premium. Furthermore, auxiliary pumps are commonly operated to increase the present of the incoming fluid to a level sufficient to fill the barrel cylinders at the maximum operating speed of the pump. However, since a pump is not always operated at its maximum speed, the auxiliary pump is providing supercharged fluid at a greater pressure than is necessary for a portion of the time the pump is operaing, which results in wasted energy.

It is desirable to provide a means for increasing the tangential velocity of the fluid entering the inlet port to substantially equal the tangential velocity of the cylinder port.

It is further desirable to have the tangential velocity of fluid entering the inlet port substantially equal to the tangential velocity of the cylinder ports at each operating speed of the pump. In other words, the means for increasing the tangential velocity of the incoming fluid should be directly proportional to the speed of the pump. It is also desirable to increase the tangential velocity of the incoming fluid without using an auxiliary pump.

SUMMARY OF THE INVENTION

The instant invention provides a pump having a pump driven impeller mounted immediately adjacent the port plate which cooperates with a collector to provide fluid to the inlet port which has a tangential velocity component substantially the same as that of the barrel cylinder ports. Consequently, only a small amount of pressure fluid in the inlet is necessary to ensure complete filling of the barrel cylinders at all operating speeds of the pump. The collector is mounted in the port cap immediately adjacent the impeller and collects fluid from the impeller which does not flow directly into the pump inlet port. Fluid from the collector passes through the impeller blades as it enters the inlet port and combines with the fluid flowing directly into the inlet port. The fluid has a resultant velocity component sufficient to completely fill the pump cylinders under all operating conditiions of the pump at a greatly reduced inlet fluid pressure.

DESCRIPTION OF THE PREFERRED EMBODIMENT

Figure 1:
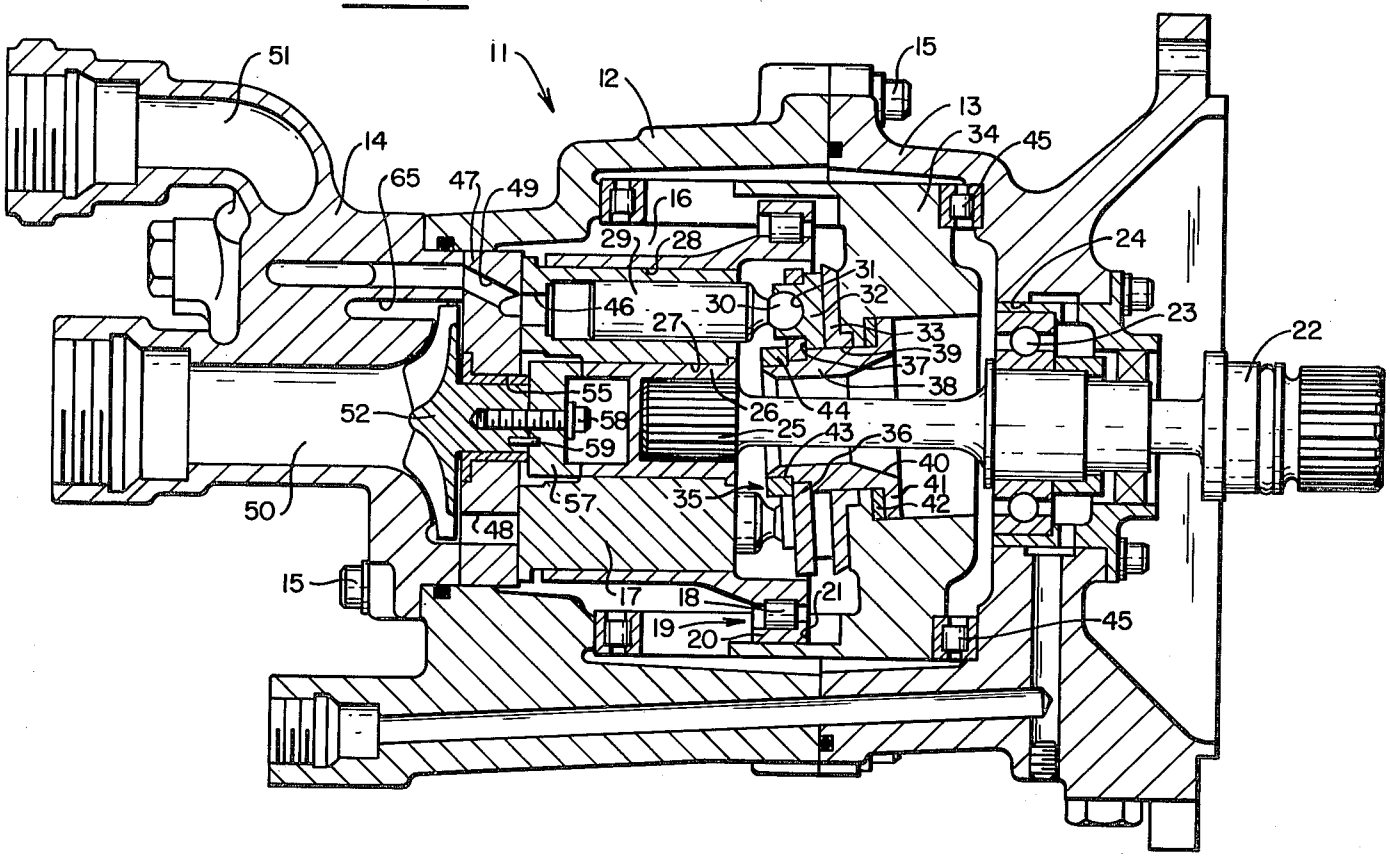
FIG. 1 is an axial cross-sectional view of a pump which incorporates the instant invention.

Referring now to FIG. 1, an axial piston pump has a case 11 which includes a central housing 12, an end cap 13 at one end and a port cap 14 at the other end, all fastened together by bolts 15.

Case 11 has a cavity 16 which receives a rotatable cylinder barrel 17 mounted on rollers 18 of a bearing 19, which has its outer race 20 pressed against a housing shoulder 21. A drive shaft 22 is rotatably supported in a bearing 23 mounted in a bore 24 in end cap 13. The inner splined end 25 of drive shaft 22 drivingly engages a splined bushing 26 pressed into central bore 27 of barrel 17.

Barrel 17 has a plurality of parallel bores 28 equally spaced circumferentially about its rotational axis. Each bore 28 receives a piston 29. Each piston 29 has a ball-shaped head 30 which is received in a socket 31 of a shoe 32.

Each shoe is retained against a flat thrust plate 33, mounted on a movable yoke 34 by a shoe retainer assembly 35. Assembly 35 includes a shoe retainer plate 36 with a number of equally spaced bores, equal to the number of pistons 29, which passes over the body of each piston and engages a shoulder 37 on each shoe 32. A post 38 passes through a central bore 39 in retainer plate 36 and a central bore 40 in yoke 34. The enlarged end 41 of post 38 engages a shoulder 42 formed on yoke 34. The small end 43 of post 38 is threaded and receives a nut 44 which clamps shoe retainer plate 36 and thrust plate 33 against yoke 34.

Yoke 34 is pivotally mounted in a pair of bearings 45, 45' for movement about an axis perpendicular to that of drive shaft 22. This changes the angle of inclination of thrust plate 33 and thereby changes the stroke or displacement of the pistons 29.

Figure 4:
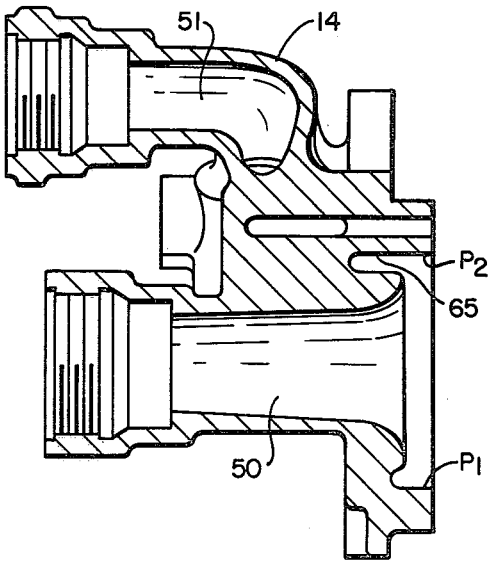
FIG. 4 is an axial cross-sectional view of the port cap and the collector.
Figure 5:
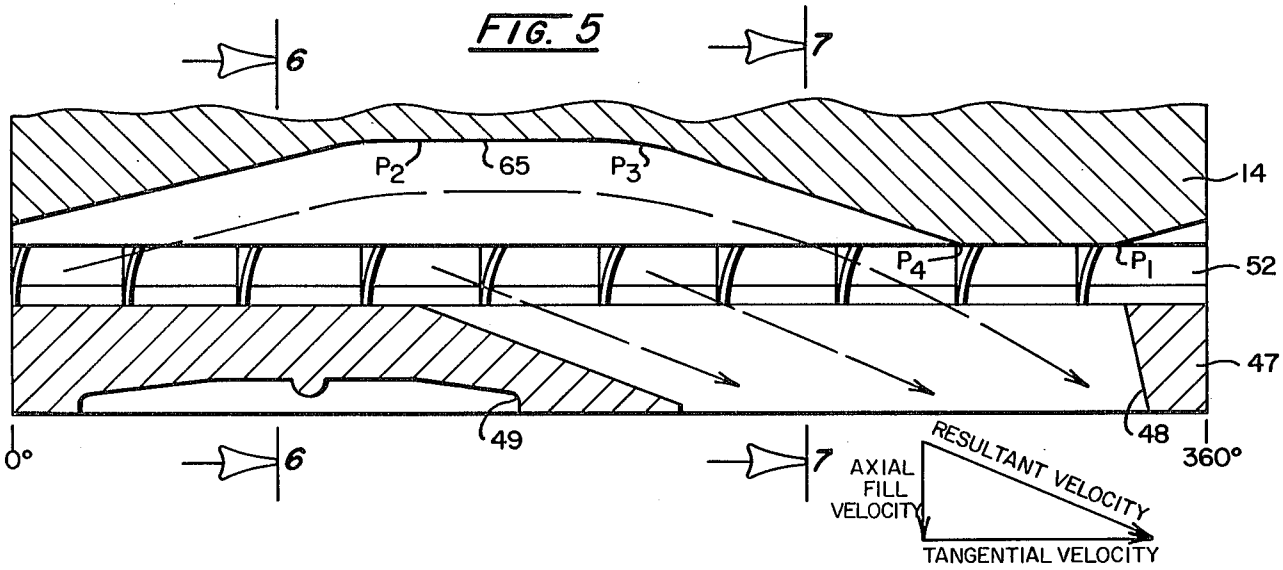
FIG. 5 is an enlarged developmental view of the collector looking along the circumference of the impeller and includes a vector diagram of the fluid entering the inlet port.
Figure 7:
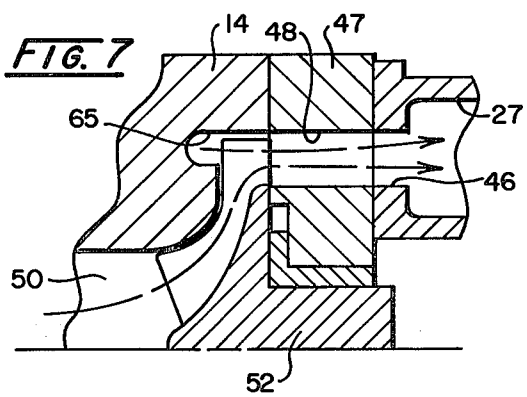
FIG. 7 is a cross-sectional view along line 7—7 of FIG. 5.
Figure 6:
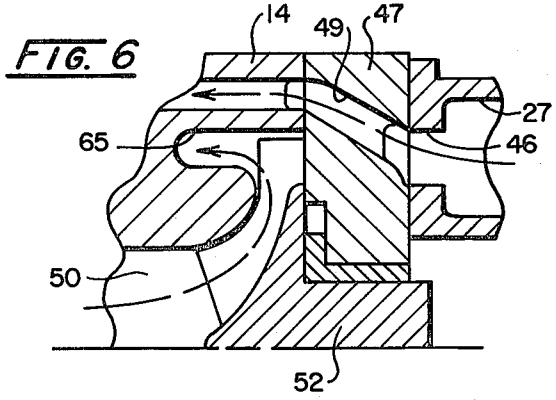
FIG. 6 is a cross-sectional view along line 6—6 of FIG. 5.

Each cylinder bore 28 ends in a cylinder port 46, which conducts fluid between a port plate 47 and the piston bore 27. Port plate 47 is positioned between barrel 17 and port cap 14. Referring to FIGS. 5–7, an inlet port 48 and an exhaust port 49 are both formed in port plate 47. These ports communicate with inlet and exhaust ports 50, 51, respectively, formed in port cap 14, as seen in FIGS. 1 and 4.

Rotation of drive shaft 22 by a prime mover, not shown, will rotate cylinder barrel 17. If thrust plate 33 is inclined from a neutral position, i.e., normal to the axis of shaft 22, the pistons 29 will reciprocate as the shoes 32 slide over the thrust plate 33. As the pistons 29 move away from port plate 47, low pressure fluid from inlet port 48 enters the cylinder bores 28. As the pistons move toward the port plate 47, they expel high pressure fluid into the exhaust port 49.

Figure 2:
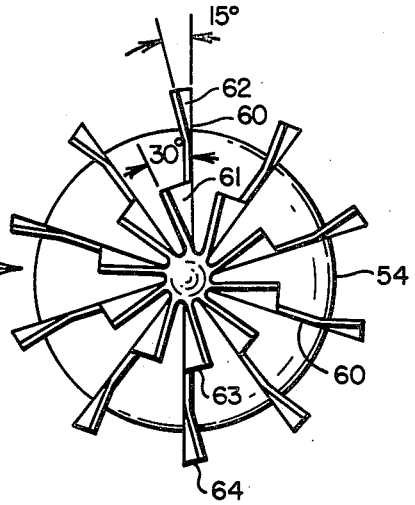
FIG. 2 is a front view of the impeller used in the instant invention.
Figure 3:
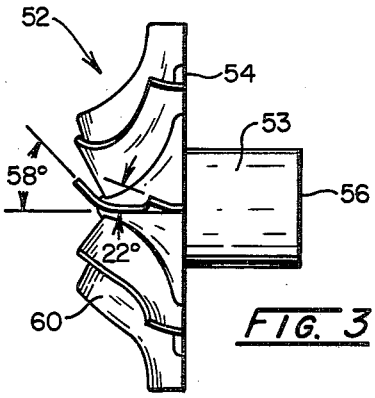
FIG. 3 is a side view of the impeller shown in FIG. 2.

Referring to FIGS. 1–3, an impeller 52 is mounted in the pump immediately adjacent port plate 47. The impeller 52 comprises a cylindrical hub 53 which projects from the back of a flat wall 54. The hub 52 projects through a hole 55 in port plate 47 and hub end 56 abuts a retainer 57. Retainer 57 is connected to spline bushing 26 by tangs which project from the retainer 57 and engage slots in the bushing 26. A bolt 58 rigidly connects the impeller 52 to the retainer 57 and a dowel 59 prevents relative movement between the two elements.

Ten equally spaced vanes project laterally and radially from the front of wall 54. Each vane 60 has an inner blade 61 and an outer blade 62. Referring to FIG. 2, the angled leading edge of inner blade 61 is offset 30° from the axis of vane 60 and the angled leading edge of outer blade 62 is offset 15° from the axis. Referring to FIG. 3, the outer end 63 of inner blade 61 is offset approximately 58° from the axis of vane 60, as viewed in FIG. 3, and the outer end 64 of outer blade 62 is offset approximately 22° from the axis.

It is important that the cross-sectional areas of the impeller sections, i.e., the spaces between the vanes 60, remain constant so that the inlet or axial velocity of the fluid remains constant as the fluid flows through the impeller. In the instant impeller 52, the front of wall 54 is cone-shaped as best seen in FIG. 3. A constant cross-sectional area between adjacent vanes 60 is maintained despite the cone-shaped wall 54 by having the distance between adjacent vanes 60 increase from the center of the impeller to the outer edge of the impeller and by making the inner blades 61 on each vane 60 wider than the outer blades 62.

The purpose of the impeller 52 is to impart additional energy to the fluid in the inlet port 50 to thereby prevent cavitation when the pump is driven at higher speeds than are normally possible on conventional pumps when the fluid in the inlet is not supercharged. The impeller 52 cooperates with a collector 65 formed in port cap 14 to provide the fluid entering the inlet port 48 in port plate 47 with a tangential velocity component substantially equal to the tangential velocity of the cylinder ports 46. Consequently, the fluid entering the inlet 50 in port cap 14 need only possess sufficient energy to provide an axial velocity component sufficient to move the fluid into the piston bore 27 as the piston sweeps across the inlet port 48. It has been found that the axial velocity component is substantially less than the tangential velocity component.

Referring to FIGS. 4–7, the collector 65 is a cavity formed in port cap 14 adjacent impeller 52 on the opposite side of port plate 47. Collector 65 begins at point $P_1$ just beyond inlet port 48 in the direction of impeller rotation and expands in cross-sectional area to a maximum at point $P_2$ which is just opposite the entrance of inlet port 48. The cross-sectional area of collector 65 is constant from point $P_2$ to point $P_3$ in the direction of impeller rotation, which point is opposite where inlet port 48 breaks through port plate 47 on the side adjacent barrel 17. From point $P_3$ to a point $P_4$ opposite the midpoint of port 48, the cross-sectional area of collector 65 decreases. From point $P_4$ to point $P_1$ in the direction of impeller rotation, there is no collector cavity. There is only sufficient clearance for impeller 52 to rotate relative to port cap 14. There is also clearance for the impeller 52 to rotate with respect to port plate 47.

In operation, fluid in low pressure or inlet port 50 moves axially toward the center of impeller 52. The inner blades 61 on vanes 60 tend to guide the fluid into the impeller sections. As the fluid traverses the impeller sections it is turned in a radial direction and it receives an increasing tangential velocity component. This component is in the direction of impeller rotation. Oil exiting the impeller sections adjacent the inlet port 48 flows directly into inlet port 48. This occurs between points $P_2$ and $P_4$. Oil exiting from the impeller between points $P_1$ and $P_2$ and the direction of impeller rotation enters collector 65. The expanding cross-sectional area of collector 65 between points $P_1$ and $P_2$ enables the fluid to maintain a high tangential velocity at all times. This reduces energy losses caused by fluid stopping or slowing down and subsequently having to be re-accelerated.

FIG. 6 shows fluid exiting the impeller 52 into collector 65 prior to where the collector opens into the inlet port 48, i.e., between points $P_1$ and $P_2$. Referring to FIGS. 5 and 7, it can be seen that between points $P_2$ and $P_4$ fluid from the collector 65 mixes with fluid radiating directly from the impeller 52, and enters the inlet port 48 in port plate 47. The fluid exiting the collector 65 engages the outer blades 62 of the impeller 52 as it flows from the collector 65 into the inlet port 48. This enables the outer blades 62 to impart additional velocity before it flows into inlet port 48. A vector diagram of the velocity components of the fluid entering inlet port 48 is shown in FIG. 5 adjacent inlet port 48. The resultant velocity is the combination of the tangential velocity which has been imparted to the fluid by the impeller 52 and an axial fill velocity which is caused by the pressure of the fluid in the inlet port 50.

Figure 8:
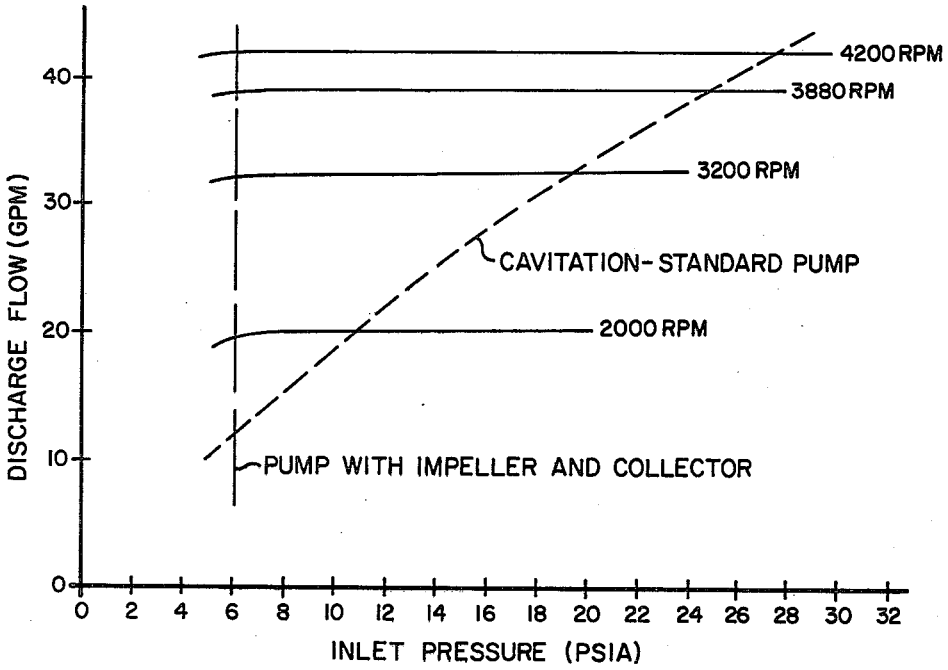
FIG. 8 is a graph showing the required pressure of inlet fluid in a conventional pump and the pressure of the inlet fluid in an identical pump which incorporates the instant invention.

FIG. 8 is a graph showing the relationship of inlet pressure to discharge flow at various pump speeds. It has been found that in a standard pump, i.e., one without the impeller and collector of the instant invention, the minimum inlet pressure in inlet port 50 must increase substantially as the speed of the pump increases to prevent cavitation of the pump. The reason for this is that more energy must be imparted to the fluid in order for it to fill the cylinder bores in the time the cylinder ports 46 are opened to the inlet port 48. However, in a pump with the impeller and collector of the instant invention it has been found that the pump can be operated between its minimum and maximum speeds with an inlet pressure of approximately six pounds per square inch absolute. This greatly increases the performance of the pump by enabling it to operate at high speeds without having to supercharge the fluid at the inlet.

An additional advantage of the impeller and collector of the instant invention is that little additional power is required from the pump to operate the impeller 52 and impart the required resultant velocity component to the fluid. The power required is approximately one fourth of that required by a conventional centrifugal pump to supercharge the fluid and do the same job.

Obviously, those skilled in the art may make various changes in the details and arrangements of parts without departing from the spirit and scope of the invention as it is defined by the claims hereto appended.

What is claimed is:

1. An axial piston pump which comprises: a housing, a port cap which closes one end of the housing, a barrel rotatably mounted in the housing, a shaft attached to the barrel for driving the barrel, a plurality of pistons mounted in bores for reciprocation within the barrel, a port plate having an inner face adjacent one end of the barrel, an inlet port in the port plate for directing low pressure fluid to the pistons, an outlet port in the port plate for receiving discharge pressure fluid from the pistons, an impeller rotatably connected to the drive shaft adjacent the outer face of the port plate, means for supplying low pressure fluid to the center of the impeller to enable the impeller to impart a tangential velocity to the fluid, characterized by a collector formed in the port cap adjacent the outer face of the port plate which receives a portion of the fluid from the impeller, wherein the inlet of the collector is just beyond the inlet port in the direction of impeller rotation and the exit of the collector is adjacent the beginning of the inlet port in the direction of impeller rotation, such that the collector is adjacent the major portion of the impeller's circumference, the collector directs the axial velocity component of the fluid in the direction of the inlet port, means for directing a substantial portion of the fluid exiting from the collector back into the impeller before it flows into the inlet port to thereby increase the fluid's tangential velocity to that of the piston barrel cylinder ports, wherein the fluid from the collector which enters the impeller combines with fluid which flows directly from the impeller to the inlet port and the combined fluid entering the inlet port is at substantially the same tangential velocity as the piston barrel ports.

2. An axial piston pump which comprises: a housing, a port cap which closes one end of the housing, a barrel rotatably mounted in the housing, a shaft attached to the barrel for driving the barrel, a plurality of pistons mounted in bores for reciprocation within the barrel, a port plate having an inner face adjacent one end of the barrel, an inlet port in the port plate for directing low pressure fluid to the pistons, an outlet port in the port plate for receiving discharge pressure fluid from the pistons, an impeller rotatably connected to the drive shaft adjacent the outer face of the port plate, means for supplying low pressure fluid to the center of the impeller to enable the impeller to impart a tangential velocity to the fluid, characterized by a collector formed in the port cap adjacent the outer face of the port plate which receives a portion of the fluid from the impeller, wherein the inlet of the collector is just beyond the inlet port in the direction of impeller rotation and the exit of the collector is adjacent the beginning of the inlet port in the direction of impeller rotation, such that the collector is adjacent the major portion of the impeller'circumference, the collector directs the axial velocity component of the fluid in the direction of the inlet port, means for directing a substantial portion of the fluid exiting from the collector back into the impeller before it flows into the inlet port to thereby increase the fluid's tangential velocity to that of the piston barrel cylinder ports, wherein the fluid from the collector which enters the impeller combines with fluid which flows directly from the impeller to the inlet port and the combined fluid entering the inlet port is at substantially the same tangential velocity as the piston barrel ports, wherein the collector volume increases in the direction of impeller rotation from the entrance of the collector to the beginning of the port plate slot, the collector volume is constant from the beginning of the port plate slot until it is directly in line with the entrance of the inlet port on the barrel face side and the collector volume decreases from the entrance of the inlet port to the midpoint of the inlet port.

* * * * *

UNITED STATES PATENT AND TRADEMARK OFFICE

CERTIFICATE OF CORRECTION

PATENT NO. : 4,281,971

DATED : August 4, 1981

INVENTOR(S) : Herbert H. Kouns

It is certified that error appears in the above—identified patent and that said Letters Patent is hereby corrected as shown below:

Column 1, line 60, "present" should read -- pressure --.

line 65, "operaing" should read -- operating --.

Column 2, line 30, "conditiions" should read -- conditions --.

Column 3, line 45, "spline" should read -- splined --.

Column 4, line 48, "and" should read -- in --.

Signed and Sealed this

*Thirteenth* Day of *October 1981*

[SEAL]

*Attest:*

GERALD J. MOSSINGHOFF

*Attesting Officer*

*Commissioner of Patents and Trademarks*